US011649097B2

(12) United States Patent
Grankowski et al.

(10) Patent No.: US 11,649,097 B2
(45) Date of Patent: May 16, 2023

(54) BOTTLE SYSTEM WITH A STORAGE CONTAINER

(71) Applicant: Zak Designs, Inc., Spokane, WA (US)

(72) Inventors: Greg Grankowski, Greenacres, WA (US); Andrew Gillespie, South Easton, MA (US)

(73) Assignee: Zak Designs, Inc., Spokane, WA (US)

( * ) Notice: Subject to any disclaimer, the term of this patent is extended or adjusted under 35 U.S.C. 154(b) by 0 days.

(21) Appl. No.: 17/472,329

(22) Filed: Sep. 10, 2021

(65) Prior Publication Data

US 2023/0084662 A1 Mar. 16, 2023

(51) Int. Cl.

| | |
|---|---|
| ***B65D 51/28*** | (2006.01) |
| ***B65D 43/02*** | (2006.01) |
| ***B65D 51/24*** | (2006.01) |
| ***A45F 3/18*** | (2006.01) |

(52) U.S. Cl.

CPC ..... *B65D 51/28* (2013.01); *A45F 3/18* (2013.01); *B65D 43/0229* (2013.01); *B65D 51/242* (2013.01); *B65D 2543/00092* (2013.01); *B65D 2543/00231* (2013.01); *B65D 2543/00518* (2013.01); *B65D 2543/00546* (2013.01)

(58) Field of Classification Search

CPC .. B65D 51/28; B65D 43/0229; B65D 51/242; B65D 2543/00092; B65D 2543/00231; B65D 2543/00518; B65D 2543/00546; A45F 3/18

USPC ..... 215/227

See application file for complete search history.

(56) References Cited

U.S. PATENT DOCUMENTS

| | | | | |
|---|---|---|---|---|
| 2,003,460 | A * | 6/1935 | Paull | B65D 41/0485 16/444 |
| 4,475,654 | A * | 10/1984 | Fruchter | A61J 1/03 220/345.2 |
| 5,366,089 | A * | 11/1994 | Parker | A45F 3/18 206/549 |
| 7,213,620 | B2 * | 5/2007 | DeJonge | B65D 47/12 141/22 |
| 8,141,727 | B2 * | 3/2012 | Gruenwald | B65D 23/12 221/265 |
| 9,038,845 | B1 * | 5/2015 | Buck | B65D 51/28 220/521 |
| 2016/0130052 | A1 * | 5/2016 | Stenglein | A47J 43/07 220/212 |
| 2019/0352065 | A1 * | 11/2019 | Pham | A61J 1/03 |

FOREIGN PATENT DOCUMENTS

| | | | | |
|---|---|---|---|---|
| AU | 2015328025 | A1 * | 5/2017 | A45D 33/00 |

* cited by examiner

*Primary Examiner* — Jennifer Robertson
*Assistant Examiner* — Eric C Baldrighi
(74) *Attorney, Agent, or Firm* — Randall Danskin, P.S.

(57) ABSTRACT

A bottle system has a liquid container with a reservoir therein and a lid that releasably engages with the liquid container and, thereby, selectively seals the reservoir when engaged with the liquid container. A slot is in the lid. A storage container inserts through the slot and, thereby, releasably engages the lid when inserted through the slot. The lid forms a barrier that separates the storage container from liquid when liquid is present in the reservoir.

19 Claims, 5 Drawing Sheets

BOTTLE SYSTEM WITH A STORAGE CONTAINER

BACKGROUND

Various personal, liquid-dispensing containers and related covers or lids have been fabricated and sold over many decades. In the present day, such devices are often referred to generically as "water bottles," though they frequently contain liquids other than water, or simply "bottles." For many years, these personal, liquid-dispensing containers and their associated covers or lids, or water bottles, have been designed to meet the particular needs of the users during their various events and activities. For example, water bottles have been specifically designed for running, cycling, hiking, rock climbing, driving an automobile, attendance at sporting events, and the like. People carrying a water bottle with them often carry other articles separately during their events, travels, and activities. Given the prevalence of persons carrying multiple articles, a multiple-purpose, liquid-dispensing container with a lid would be beneficial to reduce the number of articles carried separately.

BRIEF DESCRIPTION OF THE DRAWINGS

Some embodiments are described below with reference to the following accompanying drawings.

DETAILED DESCRIPTION

One potential way to provide a multiple-purpose, liquid-dispensing container with a lid (that is, a bottle) includes associating a separate storage container with the bottle. The storage container might be used to retain a variety of articles, such as door keys, medication, drink flavoring, jewelry, etc. The lid of a bottle presents a possible use as both a structure to seal liquid within the liquid container and to retain articles within the lid separately from the liquid. Lids may be designed to retain articles within a void inside the lid and to provide selective access to the articles through a door, hatch, etc. FIGS. 1-5 show one of the devices described herein implementing such a concept.

Figure 1:
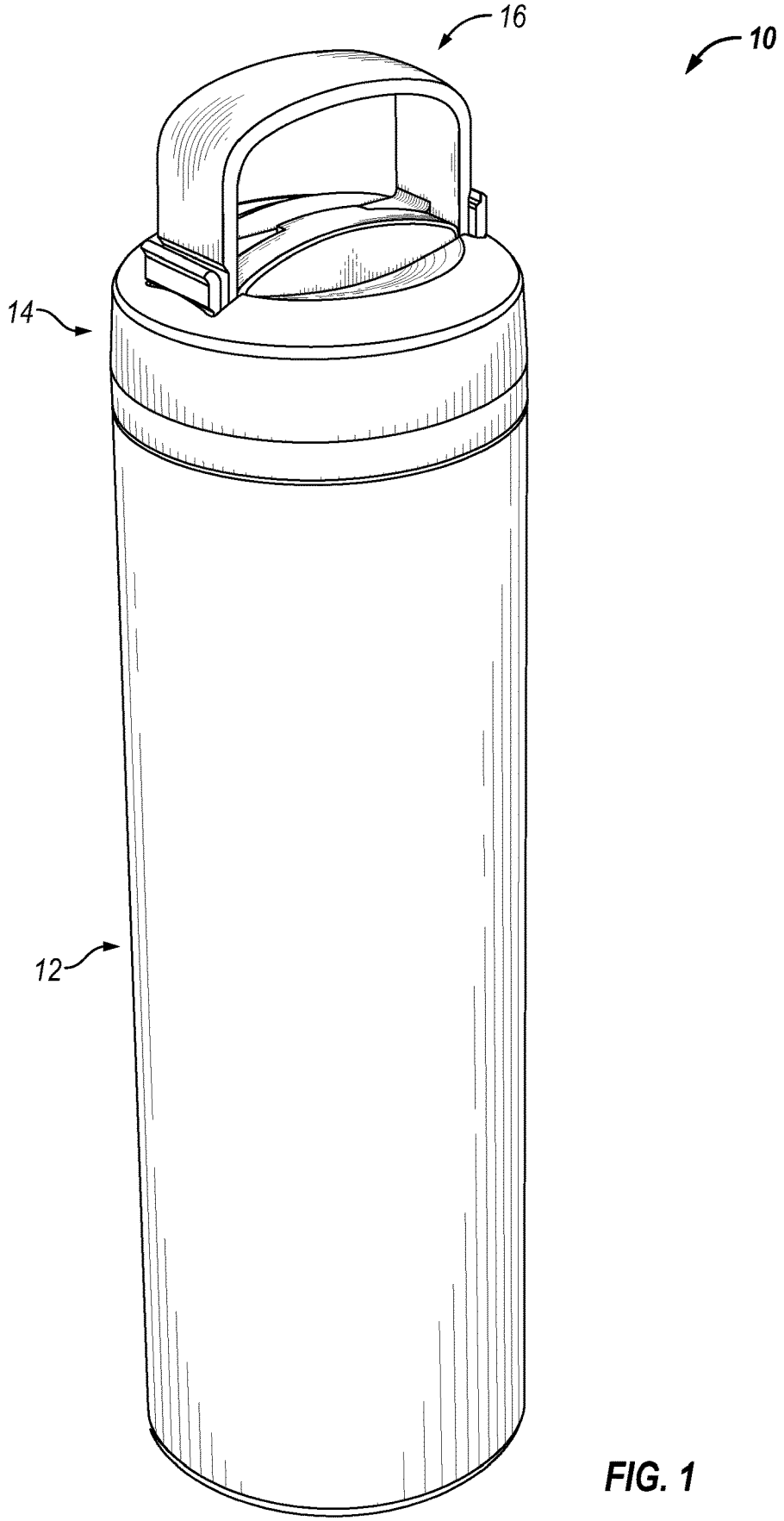
FIG. 1 is a perspective view of a bottle system with a storage container, according to one of the devices described herein.

In FIG. 1, a bottle system 10 includes a liquid container 12 configured to store liquid therein and a lid 14 configured to releasably engage with liquid container 12. As the term is used herein, a structure that "releasably engages" with another structure refers to the capability of the structures to engage selectively and to release selectively from engagement when desired by the user. Accordingly, lid 14 selectively seals liquid inside liquid container 12 when engaged with liquid container 12. Bottle system 10 also includes a storage container 16 inserted into lid 14. By the mechanisms described herein, storage container 16 maybe inserted into lid 14, releasably engaged with lid 14, and removed from lid 14 to access a compartment 20 within storage container 16. While FIGS. 1-5 show one example of mechanisms accomplishing the described functions, other mechanisms may be suitable for accomplishing similar functions in keeping with the descriptions herein.

FIGS. 2-5 show further detail of storage container 16 and lid 14, including how they cooperate one with the other. Lid 14 includes a slot 40 formed in the lid through which storage container 16 may be inserted. Upon sufficient insertion, a retainer 26 engages the lid and releasably retains storage container 16 in association with lid 14. In addition to providing a cavity (not shown), wherein storage container 16 may be inserted, and sealing liquid within liquid container 12, lid 14 additionally forms a barrier that separates storage container 16 from liquid when liquid is present in liquid container 12.

Figure 2:
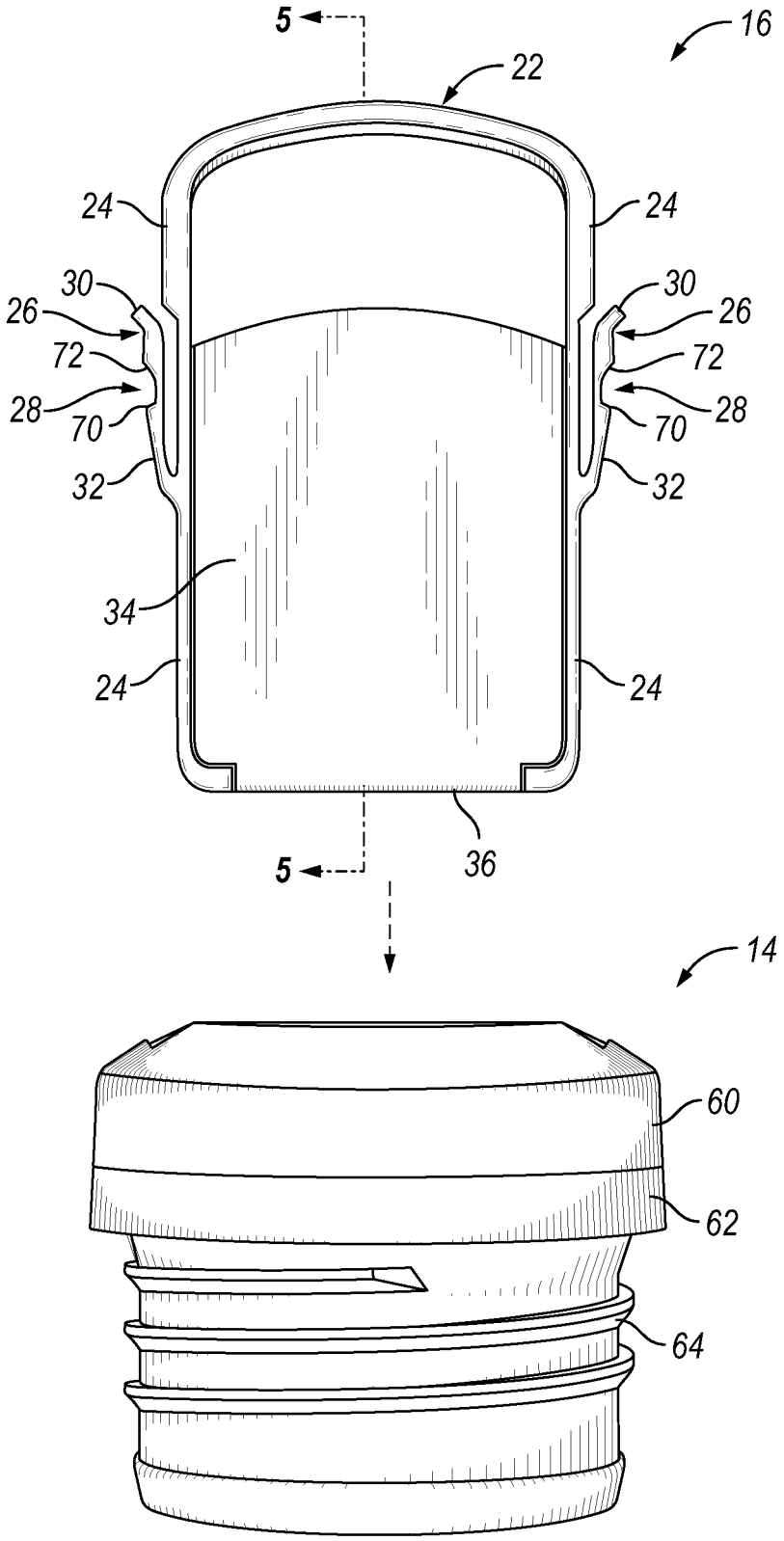
FIG. 2 is a side view of the lid and the storage container of the bottle system shown in FIG. 1 with the storage container removed.
Figure 3:
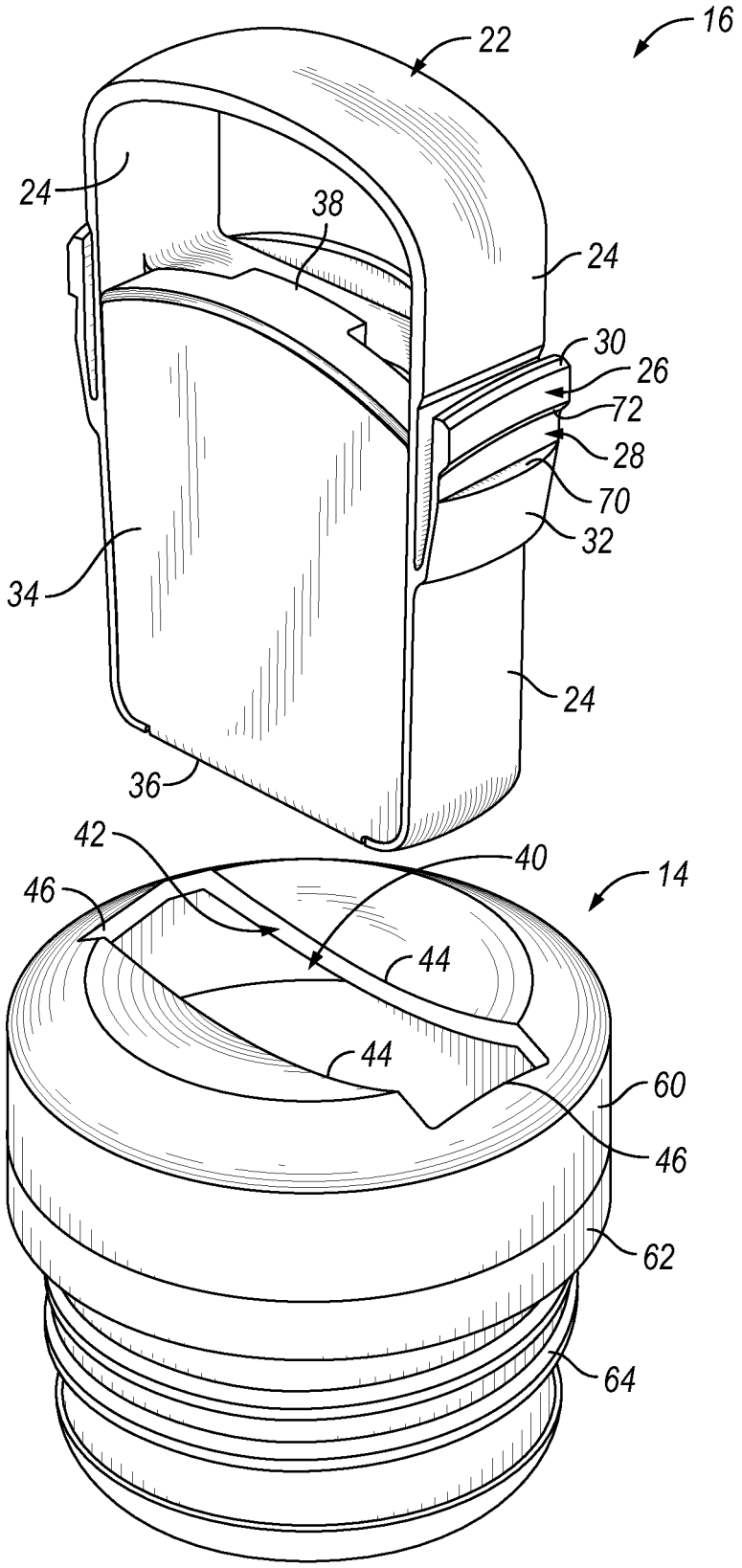
FIGS. 3 and 4 are perspective views of the lid and storage container shown in FIG. 2.
Figure 4:
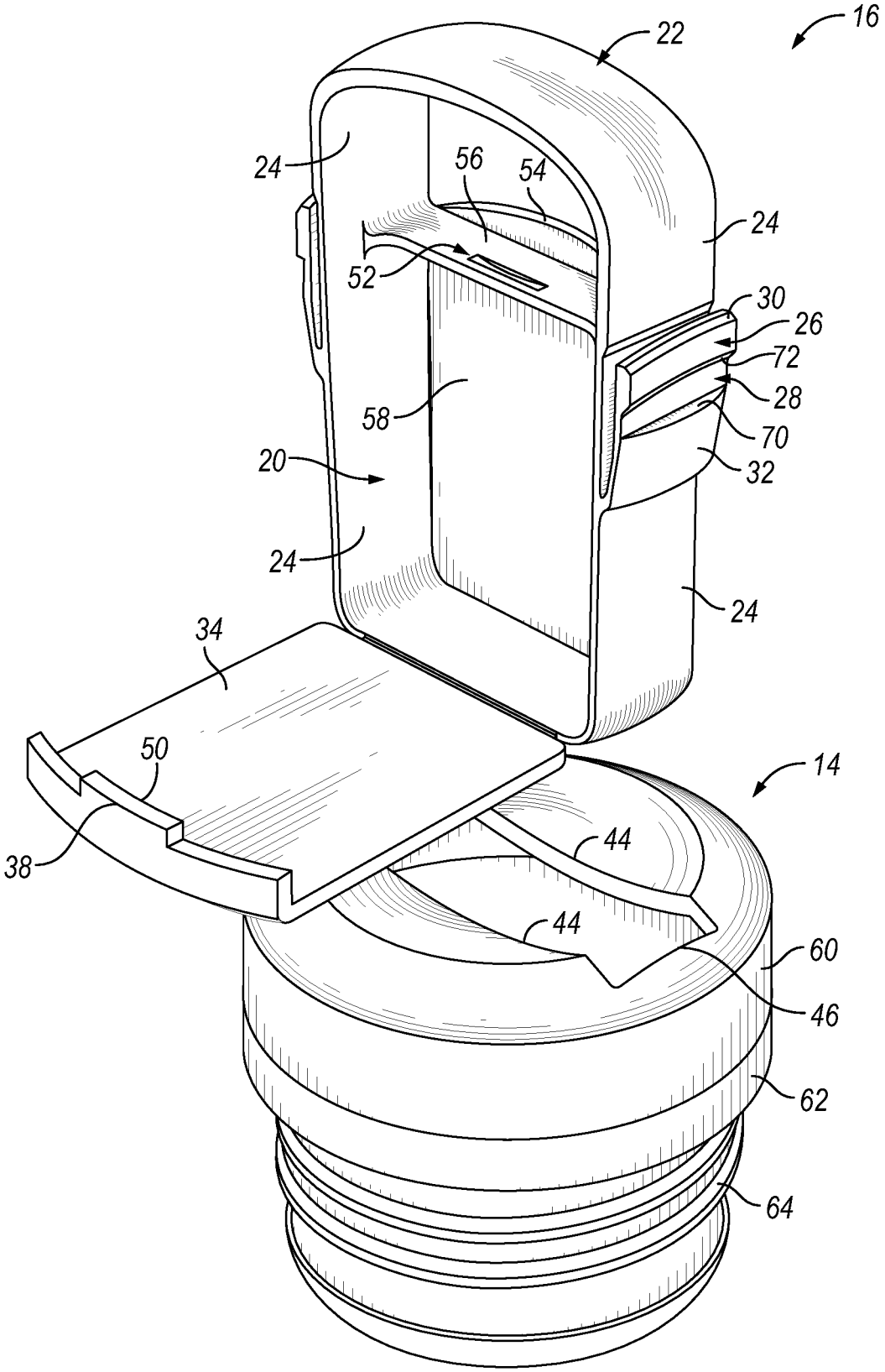

Lid 14 includes a top piece 60 with slot 40 formed therethrough and a bottom piece attached to top piece 60. In FIGS. 2-4, a threadwall 62 is shown as one example of a suitable bottom piece. Threadwall 62 has external threads 64 thereon. In such case, bottle system 10 may include internal threads (not shown) on liquid container 12 complementary to external threads 64 of threadwall 62. As such, the combination of external threads 64 and internal threads (not shown) provide a threaded releasable engagement between lid 14 and liquid container 12. Although the example of a bottom piece shown in FIGS. 2-4 provides a threaded engagement, other forms of releasably engaging structures may be used to accomplish the same functions described herein for lid 14.

In FIGS. 2-4, top piece 60 is shown as a separate element from threadwall 62, but attached together by adhesive, welding, or other attachment mechanisms or methods. As such, top piece 60 and threadwall 62 may be formed from different materials, whether in color, composition, or both. However, it will be appreciated from the additional description herein that top piece 60 may be formed integrally with threadwall 62 or some other form of a bottom piece. For example, the two pieces may be formed from the same material in common, such as by injection molding.

Although not expressly shown in FIGS. 1-5, it is implicit from the interaction of storage container 16 with lid 14 that a cavity exists within lid 14 between top piece 60 and threadwall 62 (the bottom piece). Slot 40 opens into the cavity and storage container 16 is received into the cavity when inserted through slot 40. The cavity may be just large enough to accommodate the portion of storage container 16 inserted into lid 14 through slot 40. Instead, the cavity could be much larger.

For example, top piece 60 and the bottom piece (e.g., threadwall 62) could be formed of merely an exterior wall of a thickness sufficient to provide structural support while much of the volume of lid 14 is occupied by the cavity. In such case, one might consider that additional storage volume potentially exists within lid 14 but outside storage container 16 to the extent that storage container 16 may retain articles within lid 14 when inserted through slot 40. Although, extraneous articles placed within the potential extra storage space in lid 14 could interfere with inserting storage container 16 and engaging with lid 14. Consequently, placing articles within compartment 20 would be the more beneficial.

Storage container 16 includes a frame 24 that provides structural support for other elements of storage container 16. For example, a back wall 58 is attached to frame 24. Attachment may occur through the use of adhesive, welding, or other attachment mechanisms or methods or integrally forming back wall 58 with frame 24. A door 34 is positioned opposite back wall 58 when door 34 is closed. Compartment 20 is defined at least partially by back wall 58, door 34, and a part of frame 24. Door 34 selectively opens to reveal compartment 20 and selectively closed to retain articles when articles are present in compartment 20.

In the example device of FIGS. 1-5, a transom 56 further defines compartment 20 by extending between opposite sides of frame 24. As the term is used herein, "transom" refers to a transverse strut between side members, such as between parallel or nearly parallel side members of a frame.

Also, door 34 attaches to frame 24 with a hinge 36. A variety of forms for hinge 36 may be used to attach door 34 to frame 24 in a manner that permits door 34 selectively to open to reveal compartment 20 and selectively to close to retain articles in compartment 20. One example includes a "living hinge." As the term is used herein, "living hinge" refers to a thin flexible hinge or flexure bearing connecting two features. The living hinge may be made from the same material as two rigid pieces that it connects and, in that sense, may be referred to as an "integral living hinge", but integrality is otherwise not a requirement herein. Accordingly, hinge 36, whether a living hinge or another form of hinge, may be formed separately from door 34 and frame 24 and used to connect the two components after formation. Instead, door 34, hinge 36, and frame 24 may be formed at the same time from the same material in common, providing an integral living hinge.

Storage container 16 further includes a handle 22 as another part of frame 24. Handle 22 extends above lid 14 when storage container 16 is inserted through slot 40 in lid 14 and releasably engaged with lid 14. Handle 22 has a position and a surface area that, in combination, permit a user to grasp handle 22 and remove storage container 16 from slot 40. Additionally, handle 22 has a strength that supports the weight of bottle system 10 when filled with liquid and storage container 16 is inserted through slot 40 in lid 14 and releasably engaged with lid 14. The releasable engagement with lid 14 may also have sufficient strength to support the weight of bottle system 10 when filled with liquid. As such, handle 22 is convenient for removing/replacing storage container 16 from/in lid 14 as well as for carrying bottle system 10. In FIGS. 1-5, the portion of frame 24 that provides handle 22 is defined by transom 56. The portion of frame 24 above transom 56 provides handle 22 while the portion of frame 24 below transom 56 defines compartment 20.

Transom 56 also establishes a location for a recess 52 that receives an extension 50 from a grip 38 on door 34. As the terms are used herein, a "grip" or a "retainer" refers to a device for grasping or holding one feature to another feature and includes a snap, catch, clip, clasp, hook, like structures, and other structures. As the term is used herein, a "snap" refers to a catch or fastening that closes or locks with a click and includes features provided with a spring or with parts that fit tightly into each other.

Figure 5:
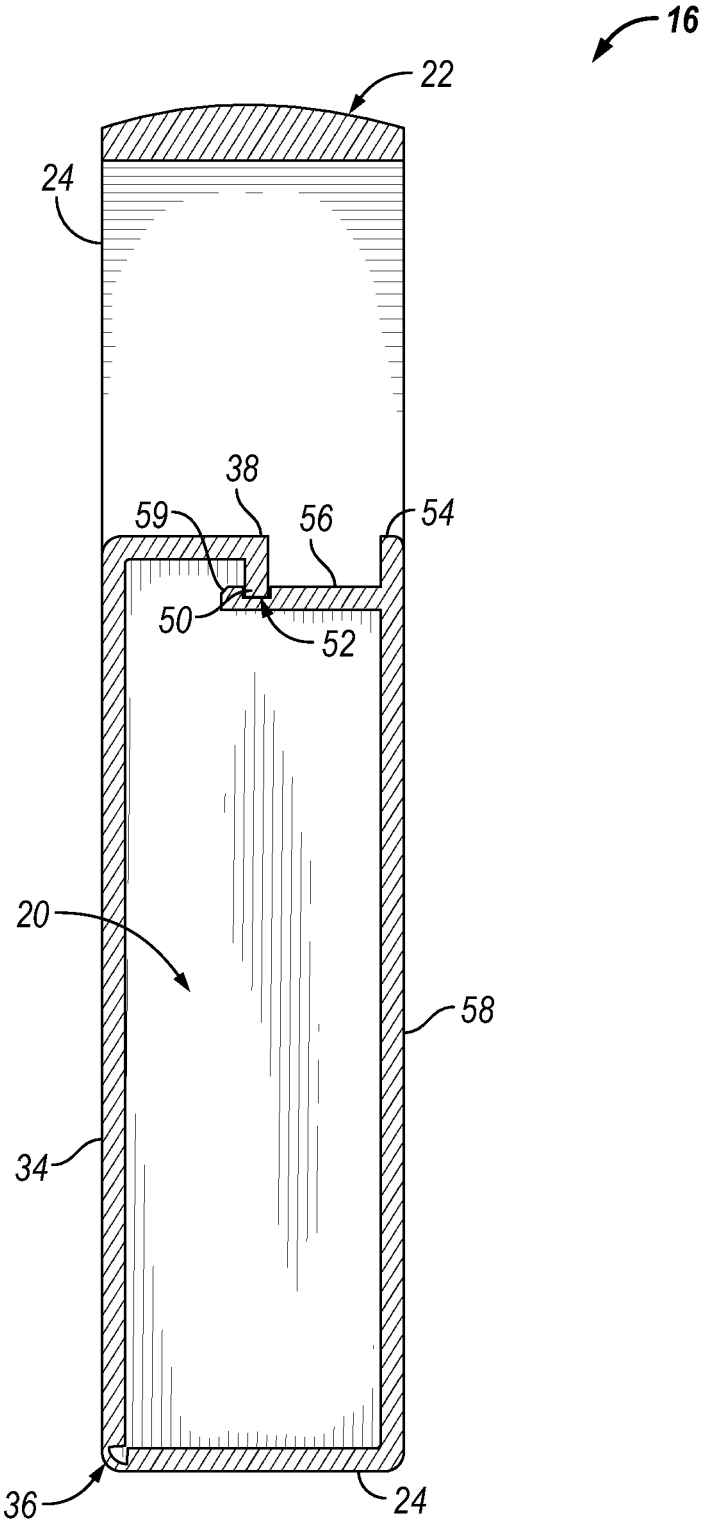
FIG. 5 is a cross-sectional view of the storage container shown in FIG. 2 taken along line 5-5.

In operation, when door 34 of storage container 16 in FIG. 4 moves from the open position to the closed position in FIG. 5, extension 50 slides over a bevel 59 of transom 56 and drops into recess 52, retaining door 34 in the closed position. Relying upon accurate tolerances of design and construction, the action of extension 50 sliding over bevel 59 may slightly bend grip 38 upward to induce a spring-like tension such that extension 50 snaps into place upon reaching recess 52. Inducing spring-like tension in grip 38 to seat extension 50 in recess 52 more securely retains door 34 in a closed position since the same bending in grip 38 would be induced to open door 34. Consequently, grip 38 is shown with a raised profile above transom 56 enabling a user to apply sufficient force to overcome the spring-like tension and open door 34.

Storage container 16 also includes a ledge 54 extending from back wall 58 as a protection of grip 38. As apparent from the profiles shown in FIG. 5, ledge 54 decreases the likelihood of accidentally bumping grip 38 and accidentally opening door 34. As the term is used herein, "ledge" refers to a raised or projecting edge or molding added to protect or check.

Bottle system 10 also includes a mechanism that releasably engages storage container 16 to lid 14. The mechanism may include a rim 42 defining slot 40 in lid 14 in combination with a retainer 26 attached to frame 24 of storage container 16. A recess 28 formed in retainer 26 releasably engages rim 42 of lot 40. Thereby, recess 28 selectively retains storage container 16 when storage container 16 is inserted through slot 40. FIGS. 1-4 show one example of a rim/retainer mechanism.

Rim 42 of slot 40 includes two longitudinal edges 44 between which compartment 20 passes when inserted through slot 40. Also, rim 42 includes two lateral edges 46 between which compartment 20 passes when inserted through slot 40. As the terms are used herein, "longitudinal" refers to a feature of or relating to the lengthwise dimension, while "lateral" refers to a feature of or relating to the side, as in the sides or ends of a longitudinal feature.

Retainer 26 includes a spring-loaded tab 30. As the term is used herein, a "tab" refers to a short flap, loop, projection, detent, or other feature projecting from an object to facilitate its identification or grasping. As the term is used herein, "spring-loaded" refers to a feature in which a load or force is applied by means of spring tension or compression. As the term is used herein, a "spring" refers to an elastic body or device that recovers its original shape when released after being distorted.

In FIGS. 1-4, retainer 26 is shown formed integrally with a spring 32 that attaches tab 30 and recess 28 to frame 24. By depressing tab 30 toward frame 24, the user may move recess 28 closer to frame 24 and out of engagement with lateral edge 46 of rim 42. With selection of a suitable material, spring 32 recovers to its original position when tab 30 is released. In that sense, tab 30 of retainer 26 is spring-loaded. While FIGS. 1-4 show retainer 26 attached integrally to frame 24 with spring 32, it will be appreciated that the devices described herein encompass different mechanisms for a retainer attached to a frame and a recess formed in the retainer that releasably engages a lid.

For the example in FIGS. 1-4, retainer 26 also includes a forward edge 70 of recess 28 and a rearward edge 72 of recess 28. Recess 28 is between forward edge 70 and rearward edge 72. Recess 28 releasably engages one of lateral edges 46 of rim 42 when storage container 16 is inserted sufficiently through slot 40. During insertion of storage container 16, forward edge 70 approaches lateral edge 46, depressing spring 32 until lateral edge 46 seats into recess 28. Rearward edge 72 may then prevent continued insertion of storage container 16 through slot 40. To remove storage container 16, a user may depress tab 30, permitting disengagement of recess 28 from lateral edge 46 sufficiently to allow forward edge 70 to pass by lateral edge 46 while removing storage container 16. FIGS. 1-4 show two retainers 26, one each on opposite sides of frame 24. Although two retainers are included, the positioning of retainers 26 permits a user to depress both retainers 26 simultaneously with one hand and remove storage container 16 from lid 14.

Devices and Methods

The discoveries described herein identify a number of solutions that may be implemented in devices and methods also described herein. Multiple solutions may be combined for implementation, enabling still further devices and methods. The inventors expressly contemplate that the various options described herein for individual devices and methods are not intended to be so limited except where incompatible with other devices and methods. The features and benefits of individual devices herein may also be used in combination with methods and other devices described herein even though not specifically indicated elsewhere. Similarly, the features and benefits of individual methods herein may also be used in combination with devices and other methods described herein even though not specifically indicated elsewhere.

Device A includes a bottle system having a liquid container with a reservoir therein and a lid that releasably engages with the liquid container and, thereby, selectively seals the reservoir when engaged with the liquid container. A slot is in the lid. A storage container inserts through the slot and, thereby, releasably engages the lid when inserted through the slot. The lid forms a barrier that separates the storage container from liquid when liquid is present in the reservoir.

Additional features may be implemented in Device A. By way of example, the lid may include a top piece with the slot formed therethrough, a bottom piece attached to the top piece, and a cavity within the lid between the top piece and the bottom piece. The slot may open into the cavity and the storage container may be received into the cavity when inserted through the slot. Also, the bottom piece may be a threadwall having external threads thereon. The bottle system may further comprise internal threads on the liquid container that are complementary to the external threads of the threadwall and provide a threaded, releasable engagement between the lid and the liquid container.

The storage container may include a frame, a back wall attached to the frame, a door opposite the back wall when the door is closed, and a compartment defined at least partially by the back wall, the door when closed, and a part of the frame. The door may selectively open to reveal the compartment and selectively close to retain articles when articles are present in the compartment. The door may be attached to the frame with a hinge.

The storage container may include a frame and a handle as a part of the frame. The handle may extend above the lid when the storage container is inserted through the slot in the lid and releasably engaged with the lid. The handle may have a position and a surface area that, in combination, permit a user to grasp the handle and remove the storage container from the slot when released. The handle may have a strength that supports the weight of the bottle system when the reservoir is filled with liquid and the storage container is inserted through the slot in the lid and releasably engaged with the lid.

The lid may include a rim defining the slot in the lid. The storage container may include a frame, a retainer attached to the frame, and a recess formed in the retainer. The recess may releasably engage the rim of the slot, thereby, selectively retaining the storage container when inserted through the slot. The rim of the slot in the lid may include two longitudinal edges between which the compartment passes when inserted through the slot and two lateral edges between which the compartment passes when inserted through the slot. The retainer may include a spring-loaded tab, a forward edge of the recess, and a rearward edge of the recess. The recess may be between the forward edge and the rearward edge and may releasably engage one of the two lateral edges of the rim when the storage container is inserted through the slot. Depression of the spring-loaded tab may permit disengagement of the recess from the rim.

The described additional features of Device A may also be implemented in other devices and methods herein.

Device B includes a bottle system having a liquid container with a reservoir therein and a lid that releasably engages with the liquid container and, thereby, selectively seals the reservoir when engaged with the liquid container. The lid includes a top piece with a slot formed therethrough, a bottom piece attached to the top piece, and a cavity within the lid between the top piece and the bottom piece, the slot opening into the cavity. The bottle system also has a storage container that inserts through the slot and, thereby, releasably engages the lid when inserted through the slot. The storage container includes a frame, a back wall attached to the frame, a door opposite the back wall when the door is closed, and a compartment defined at least partially by the back wall, the door when closed, and a part of the frame. The door selectively opens to reveal the compartment and selectively closes to retain articles when articles are present in the compartment. The lid forms a barrier that separates the storage container from liquid when liquid is present in the reservoir. The storage container is received into the cavity when inserted through the slot.

Additional features may be implemented in Device B. By way of example, the bottom piece may be a threadwall having external threads thereon. The bottle system may further include internal threads on the liquid container that are complementary to the external threads of the threadwall and provide a threaded, releasable engagement between the lid and the liquid container. The door may attach to the frame with a hinge.

The storage container may include a handle as another part of the frame, the handle extending above the lid when the storage container is inserted through the slot in the lid and releasably engaged with the lid. The handle may have a position and a surface area that, in combination, permit a user to grasp the handle and remove the storage container from the slot when released. The handle may have a strength that supports the weight of the bottle system when the reservoir is filled with liquid and the storage container is inserted through the slot in the lid and releasably engaged with the lid. The releasable engagement with the lid may have a strength that supports the weight of the bottle system when the reservoir is filled with liquid.

The lid may include a rim defining the slot in the lid. The storage container may include a retainer attached to the frame and a recess formed in the retainer. The recess may releasably engage the rim of the slot, thereby, selectively retaining the storage container when inserted through the slot.

The rim of the slot in the lid may include two longitudinal edges between which the compartment passes when inserted through the slot and two lateral edges between which the compartment passes when inserted through the slot. The retainer may include a spring-loaded tab, a forward edge of the recess, and a rearward edge of the recess. The recess may be between the forward edge and the rearward edge and may releasably engage one of the two lateral edges of the rim when the storage container is inserted through the slot. Depression of the spring-loaded tab may permit disengagement of the recess from the rim.

The storage container may include another retainer attached to the frame on a side of the storage container opposite the retainer and another recess formed in the other retainer. The other recess may releasably engage the rim of the slot, thereby, selectively retaining the storage container when inserted through the slot.

The described additional features of Device B may also be implemented in other devices and methods herein.

Device C includes a bottle system having a liquid container with a reservoir therein and a lid that releasably engages with the liquid container and, thereby, selectively seals the reservoir when engaged with the liquid container. The lid includes a top piece with a slot formed therethrough, a bottom piece attached to the top piece, a cavity within the lid between the top piece and the bottom piece, and a rim defining the slot in the lid. The slot opens into the cavity. The bottle system includes a storage container that inserts through the slot and, thereby, releasably engages the lid when inserted through the slot. The storage container includes a frame, a back wall attached to the frame, a door opposite the back wall when the door is closed, and a compartment defined at least partially by the back wall, the door when closed, and a part of the frame. The door selectively opens to reveal the compartment and selectively closes to retain articles when articles are present in the compartment. The storage container includes a handle as another part of the frame. The handle extends above the lid when the storage container is inserted through the slot in the lid and releasably engaged with the lid. The handle has a position and a surface area that, in combination, permit a user to grasp the handle and remove the storage container from the slot. The storage container includes a retainer attached to the frame and a recess formed in the retainer. The recess releasably engages the rim of the slot, thereby, selectively retaining the storage container when inserted through the slot. The lid forms a barrier that separates the storage container from liquid when liquid is present in the reservoir. The storage container is received into the cavity when inserted through the slot.

Additional features may be implemented in Device C. By way of example, the rim of the slot in the lid may include two longitudinal edges between which the compartment passes when inserted through the slot and two lateral edges between which the compartment passes when inserted through the slot. The retainer may include a spring-loaded tab, a forward edge of the recess, and a rearward edge of the recess. The recess may be between the forward edge and the rearward edge and may releasably engage one of the two lateral edges of the rim when the storage container is inserted through the slot. Depression of the spring-loaded tab may permit disengagement of the recess from the rim.

The described additional features of Device C may also be implemented in other devices and methods herein.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

| | | |
|---|---|---|
| 10 bottle system | 30 tab | 50 extension |
| 12 liquid container | 32 spring | 52 recess |
| 14 lid | 34 door | 54 ledge |
| 16 storage container | 36 hinge | 56 transom |

-continued

TABLE OF REFERENCE NUMERALS FOR FIGURES

| | | |
|---|---|---|
| 20 compartment | 38 grip | 58 back wall |
| 22 handle | 40 slot | 59 bevel |
| 24 frame | 42 rim | 60 top piece |
| 26 retainer | 44 longitudinal edges | 62 threadwall |
| 28 recess | 46 lateral edges | 64 threads |
| | | 70 forward edge |
| | | 72 rearward edge |

What is claimed is:

1. A bottle system comprising:

a liquid container with a reservoir therein;

a lid that releasably engages with the liquid container and, thereby, selectively seals the reservoir when engaged with the liquid container;

a slot in the lid;

a storage container that inserts through the slot and, thereby, releasably engages the lid when inserted through the slot, the storage container being configured to selectively open and close while removed from the slot and the lid forming a barrier that separates the storage container from liquid when liquid is present in the reservoir; and a compartment inside the storage container, which retains articles in the compartment while the storage container is removed from the slot and the storage container is closed with articles present in the compartment.

2. The bottle system of claim 1, wherein the lid comprises:

a top piece with the slot formed therethrough;

a bottom piece attached to the top piece; and a cavity within the lid between the top piece and the bottom piece, the slot opening into the cavity and the storage container being received into the cavity when inserted through the slot.

3. The bottle system of claim 2, wherein the bottom piece is a threadwall having external threads thereon and the bottle system further comprises internal threads on the liquid container that are complementary to the external threads of the threadwall and provide a threaded, releasable engagement between the lid and the liquid container.

4. A bottle system comprising:

a liquid container with a reservoir therein;

a lid that releasably engages with the liquid container and, thereby, selectively seals the reservoir when engaged with the liquid container;

a slot in the lid; and a storage container that inserts through the slot and, thereby, releasably engages the lid when inserted through the slot, the lid forming a barrier that separates the storage container from liquid when liquid is present in the reservoir, the storage container including:

a frame;

a back wall attached to the frame;

a door opposite the back wall when the door is closed; and a compartment defined at least partially by the back wall, the door when closed, and a part of the frame, which door selectively opens to reveal the compartment and selectively closes to retain articles when articles are present in the compartment.

5. The bottle system of claim 4, wherein the door attaches to the frame with a hinge.

6. The bottle system of claim 1, wherein the storage container comprises:

a frame; and a handle as a part of the frame, the handle extending above the lid when the storage container is inserted through the slot in the lid and releasably engaged with the lid and the handle having a position and a surface area that, in combination, permit a user to grasp the handle and remove the storage container from the slot when released.

7. The bottle system of claim 6, wherein the handle has a strength that supports the weight of the bottle system when the reservoir is filled with liquid and the storage container is inserted through the slot in the lid and releasably engaged with the lid.

8. The bottle system of claim 1, wherein the lid comprises a rim defining the slot in the lid and the storage container comprises:

a frame;

a retainer attached to the frame; and a recess formed in the retainer, the recess releasably engaging the rim of the slot, thereby, selectively retaining the storage container when inserted through the slot.

9. The bottle system of claim 8, wherein:

the rim of the slot in the lid comprises:

two longitudinal edges between which the compartment passes when inserted through the slot; and two lateral edges between which the compartment passes when inserted through the slot; and the retainer comprises:

a spring-loaded tab;

a forward edge of the recess; and a rearward edge of the recess, the recess being between the forward edge and the rearward edge and releasably engaging one of the two lateral edges of the rim when the storage container is inserted through the slot, and depression of the spring-loaded tab permitting disengagement of the recess from the rim.

10. A bottle system comprising:

a liquid container with a reservoir therein;

a lid that releasably engages with the liquid container and, thereby, selectively seals the reservoir when engaged with the liquid container, the lid including:

a top piece with a slot formed therethrough;

a bottom piece attached to the top piece; and a cavity within the lid between the top piece and the bottom piece, the slot opening into the cavity; and a storage container that inserts through the slot and, thereby, releasably engages the lid when inserted through the slot, the storage container including:

a frame;

a back wall attached to the frame;

a door opposite the back wall when the door is closed; and a compartment defined at least partially by the back wall, the door when closed, and a part of the frame, which door selectively opens to reveal the compartment and selectively closes to retain articles when articles are present in the compartment, the lid forming a barrier that separates the storage container from liquid when liquid is present in the reservoir and the storage container being received into the cavity when inserted through the slot.

11. The bottle system of claim 10, wherein the bottom piece is a threadwall having external threads thereon and the bottle system further comprises internal threads on the liquid container that are complementary to the external threads of the threadwall and provide a threaded, releasable engagement between the lid and the liquid container.

12. The bottle system of claim 10, wherein the door attaches to the frame with a hinge.

13. The bottle system of claim 10, wherein the storage container comprises:

a handle as another part of the frame, the handle extending above the lid when the storage container is inserted through the slot in the lid and releasably engaged with the lid and the handle having a position and a surface area that, in combination, permit a user to grasp the handle and remove the storage container from the slot when released.

14. The bottle system of claim 13, wherein the handle has a strength that supports the weight of the bottle system when the reservoir is filled with liquid and the storage container is inserted through the slot in the lid and releasably engaged with the lid, and the releasable engagement with the lid has a strength that supports the weight of the bottle system when the reservoir is filled with liquid.

15. The bottle system of claim 10, wherein the lid comprises a rim defining the slot in the lid and the storage container comprises:

a retainer attached to the frame; and a recess formed in the retainer, the recess releasably engaging the rim of the slot, thereby, selectively retaining the storage container when inserted through the slot.

16. The bottle system of claim 15, wherein:

the rim of the slot in the lid comprises:

two longitudinal edges between which the compartment passes when inserted through the slot; and two lateral edges between which the compartment passes when inserted through the slot; and the retainer comprises:

a spring-loaded tab;

a forward edge of the recess; and a rearward edge of the recess, the recess being between the forward edge and the rearward edge and releasably engaging one of the two lateral edges of the rim when the storage container is inserted through the slot, and depression of the spring-loaded tab permitting disengagement of the recess from the rim.

17. The bottle system of claim 15, wherein the storage container comprises:

another retainer attached to the frame on a side of the storage container opposite the retainer; and another recess formed in the other retainer, the other recess releasably engaging the rim of the slot, thereby, selectively retaining the storage container when inserted through the slot.

18. A bottle system comprising:

a liquid container with a reservoir therein;

a lid that releasably engages with the liquid container and, thereby, selectively seals the reservoir when engaged with the liquid container, the lid including:

a top piece with a slot formed therethrough;

a bottom piece attached to the top piece;

a cavity within the lid between the top piece and the bottom piece, the slot opening into the cavity; and a rim defining the slot in the lid; and a storage container that inserts through the slot and, thereby, releasably engages the lid when inserted through the slot, the storage container including:

a frame;

a back wall attached to the frame;

a door opposite the back wall when the door is closed;

a compartment defined at least partially by the back wall, the door when closed, and a part of the frame, which door selectively opens to reveal the compartment and selectively closes to retain articles when articles are present in the compartment;

a handle as another part of the frame, the handle extending above the lid when the storage container is inserted through the slot in the lid and releasably engaged with the lid and the handle having a position and a surface area that, in combination, permit a user to grasp the handle and remove the storage container from the slot;

a retainer attached to the frame; and a recess formed in the retainer, the recess releasably engaging the rim of the slot, thereby, selectively retaining the storage container when inserted through the slot, the lid forming a barrier that separates the storage container from liquid when liquid is present in the reservoir and the storage container being received into the cavity when inserted through the slot.

19. The bottle system of claim 18, wherein:

the rim of the slot in the lid comprises:

two longitudinal edges between which the compartment passes when inserted through the slot; and two lateral edges between which the compartment passes when inserted through the slot; and the retainer comprises:

a spring-loaded tab;

a forward edge of the recess; and a rearward edge of the recess, the recess being between the forward edge and the rearward edge and releasably engaging one of the two lateral edges of the rim when the storage container is inserted through the slot, and depression of the spring-loaded tab permitting disengagement of the recess from the rim.

* * * * *